United States Patent [19]

Phenegar

[11] Patent Number: 4,829,621

[45] Date of Patent: May 16, 1989

[54] TOOTHBRUSH

[76] Inventor: John S. Phenegar, 20145 Scarlet St., Mount Clemens, Mich. 48043

[21] Appl. No.: 883,599

[22] Filed: Jul. 9, 1986

[51] Int. Cl.[4] ..... A46B 9/04

[52] U.S. Cl. ..... 15/172; 15/167.1; 15/144 R

[58] Field of Search ..... 15/172, 201, 160, 110, 15/143 R, 106, 144 R, 167.1; 351/178, 122, 114

[56] References Cited

U.S. PATENT DOCUMENTS

| | | | |
|---|---|---|---|
| 651,841 | 6/1900 | Flemming | 15/160 X R |
| 1,494,448 | 5/1924 | Sookne . | |
| 1,796,001 | 3/1931 | Church | 15/167 R |
| 1,928,328 | 9/1933 | Carpentier . | |
| 1,963,360 | 6/1934 | Gibbin et al. | 15/167 R |
| 2,254,365 | 9/1941 | Griffith et al. . | |
| 2,438,268 | 3/1948 | Bressler . | |
| 2,445,657 | 7/1948 | Bennett . | |
| 3,499,072 | 3/1970 | Helling . | |
| 3,589,823 | 6/1971 | Hendrickson | 15/167.1 |
| 3,609,789 | 10/1971 | Slater | 15/167 R X |
| 3,993,403 | 11/1976 | Brown | 351/178 |
| 4,227,276 | 10/1980 | Ginsburg et al. | 15/176 |
| 4,263,691 | 4/1981 | Parkarnseree | 15/167 R |
| 4,306,327 | 12/1981 | Zeski | 15/167 R |
| 4,520,526 | 6/1985 | Peters . | |
| 4,712,266 | 12/1987 | Yamaki | 15/167.1 |

FOREIGN PATENT DOCUMENTS

| | | | |
|---|---|---|---|
| 73169 | 6/1978 | Japan | 15/167.1 |
| 304459 | 1/1929 | United Kingdom | 15/143 R |

*Primary Examiner*—Peter Feldman

*Attorney, Agent, or Firm*—Brooks & Kushman

[57] ABSTRACT

An adjustable toothbrush having an elastically deformable neck section allowing the brush head to be positioned at varying angular orientations relative to the handle.

6 Claims, 1 Drawing Sheet

TOOTHBRUSH

DESCRIPTION

Field of the Invention

The invention relates to the field of toothbrushes and more particularly to toothbrushes having adjustable head/handle orientation.

Background of Invention

Everyday household toothbrushes come in a wide variety of shapes and colors but most are made up of a brush head and handle. Quite typically a toothbrush also has a narrow neck portion between the brush head and the handle to allow easier insertion of the brush into the user's mouth without interference with the user's gums and lips. Over the years various brush head designs have been utilized having arrays of brush bristles and varying lengths and varying stiffness.

Typically the brush head is an elongated rectangular member projecting from a planar elongated surface having a brush bristle array. The brush head is most commonly aligned along a common axis with the handle and neck portion of the brush. Many users prefer the brush head to be inclined slightly relative to the handle and the toothbrush of this design sold under the trademark "Reach" manufactured by Johnson & Johnson has experienced a fair degree of recent marketing success. The ability to orient the head at an angle relative to the handle is a well-known problem recognized in the art. A number of U.S. Patents specifically address this problem by making the brush head and/or neck assembly flexible to allow relative movement therebetween, i.e.: U.S. Pat. Nos. 1,494,448; 1,928,328; 2,438,268; 2,445,657; 2,254,365; and 4,520,526. The problem with having a flexible head is that the user loses a certain degree of control over head movement; and it is difficult to effectively transmit the desired brushing loads onto the teeth.

OBJECT AND ADVANTAGES OF THE INVENTION

An object of this invention is to provide a toothbrush in which the brush head may be oriented at an angle relative to the handle which is most comfortable for the user. It is another object of the invention to provide a secure connection between the brush head and handle to minimize deflection therebetween during normal use.

Advantage of the present invention is that a toothbrush may be custom-shaped by the user to achieve the most comfortable head/handle relationship.

A feature of the present invention is that the toothbrush neck may be inelastically deformed easily by the user thereby orienting the brush head and the most comfortable position relative to the handle.

SUMMARY OF THE INVENTION

In accordance with the present invention, a toothbrush which has a brush head, a handle and an inner-connecting neck. The neck is inelastically deformable, thereby allowing the neck to be bent varying the angle of orientation of the head relative to the body.

DETAILED DESCRIPTION OF THE PREFERRED EMBODIMENT

Figure 1:
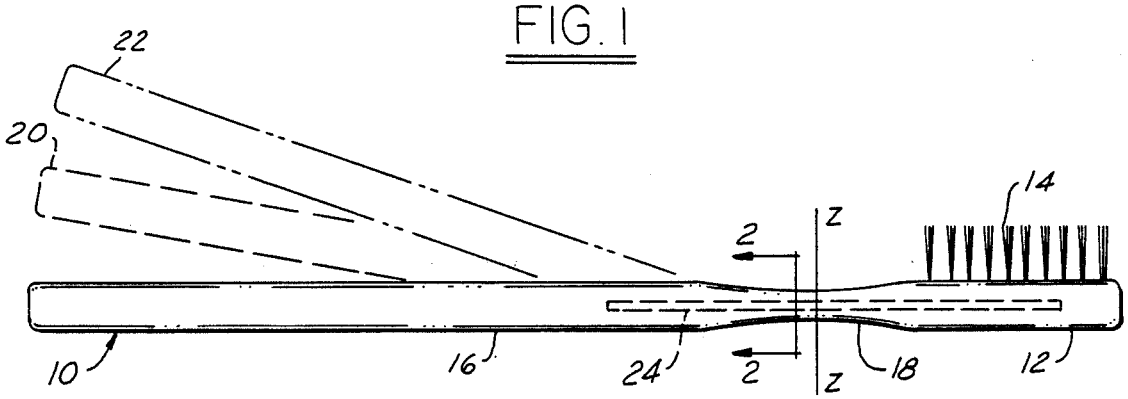
FIG. 1 is a side elevation of one embodiment of the invention.
Figure 2A:
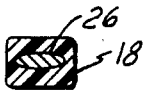
FIG. 2*a* is an enlarged cross-sectional view taken along line 2—2 of FIG. 1.
Figure 2B:
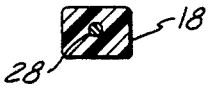
FIG. 2*b* is an alternative enlarged cross-sectional view taken along line 2—2 of FIG. 1.
Figure 3:
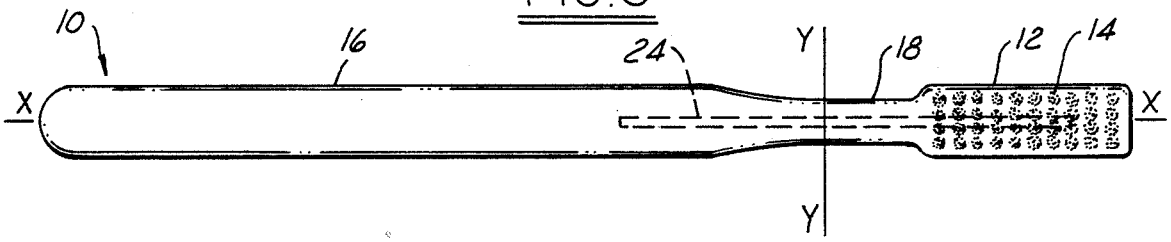
FIG. 3 is a plan view of the embodiment of the invention shown in FIG. 1.

FIGS. 1–3 show a preferred embodiment of the toothbrush invention. The toothbrush assembly 10 is provided with a brush head 12 which is generally rectangular and has projecting from one side thereof a plurality of brush bristles 14. The brush head 12 is connected to handle 16 by neck 18. Neck region 18 is preferably narrower in cross-section than the handle as shown. The brush head, the handle and neck are all preferably formed of a plastic material which is injection molded using common toothbrush manufacturing techniques. The toothbrush 10 is designed so that the angle of the brush head relative to the handle may be varied by bending the neck about axis y—y in FIG. 3. As shown in FIG. 1 in phantom outline, the handle can be moved to any one of a number of positions as represented by position 20 and 22.

To maintain the brush head in the deflected position relative to the handle, and insert 24 is provided extending through the neck and partially extending into the brush head and handle portions. Preferably the insert is formed of a ductile metal such as soft steel. The insert, however, must be capable of being bent through a 30° angle several times without work-hardening or fracturing. The insert can have an oval or rectangular cross-section as shown in FIG. 2*a* or a round cross-section as shown in FIG. 2*b*. The rectangular cross-section will allow the neck to be bent easily about the y—y axis while effectively preventing any deformation around the z—z axis. The round cross-sectional area insert as shown in FIG. 2*b* may be easily bent about the y—y axis as well as the z—z axis, however, deflection about the z—z axis will require considerably more effort as a result of the width of the plastic portion of the neck relative to its height as shown in FIG. 2*b*. A typical insert of the type shown in cross-section 2*b* can be made of material having similar diameter characteristics of the material used in a common wire coat hanger. Note that a suitable plastic must be used to allow the neck to be bent without fracturing or cracking. Numerous common thermoplastics which are readily, commercially available will work properly if sufficient hardness and glass transition temperatures are selected.

Figure 4:
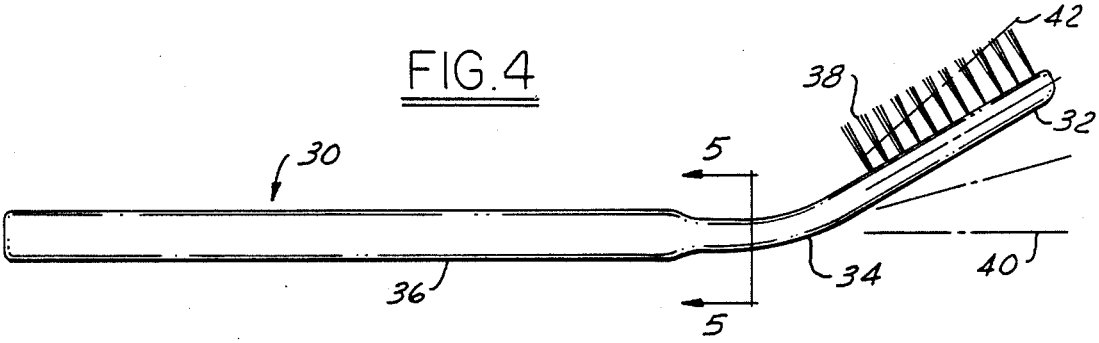
FIG. 4 is a side elevation of an alternative embodiment of the invention.
Figure 5:
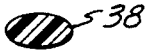
FIG. 5 is an enlarged cross-sectional view taken along line 5—5 of FIG. 4.

An alternative embodiment 30 is shown in FIGS. 4 and 5. Toothbrush 30 does not employ an insert in the neck. Rather, the neck is formed of a thermoplastic material which becomes inelastically deformable when heated in hot water. Toothbrush 30 is provided with a head assembly 32, neck 34 and handle 36. Head 32 is provided with a plurality of brush bristles 38. The head may be moved to a number of angular positions relative to the handle as a result of bending the neck about the y—y axis. The neck is shown in cross-section in FIG. 5 is preferably oval in shape having a width along the y—y axis significantly greater than its height. A neck having an oval or rectangular cross-section would thereby more easily lend itself to deformation about the y—y axis then about the z—z axis. Note that the neck portion 34 of the toothbrush 30 is significantly smaller in area than the handle or head so that when the brush is heated bending will most readily occur in the neck region. Preferably the entire toothbrush is molded of a single material which is thermoplastic and workable at a temperature significantly below the boiling temperature of water. The plastic having a softening temperature in the 175° to 200° range would work well if the brush is to be deformed using water heated on the stove. The brush can alternatively be designed of a material having a lower softening point so that it may be heated and deformed using ordinary hot tap water. Since household tap water typically has a maximum temperature of 130° for safety reasons, a material should be selected which starts to soften in the 120° to 130° range. Various commercial plastics are readily available having a low softening temperature such as polystyrene and ABS (acrylonitrile butadiene styrene).

In both the first and second embodiment of the invention, the most comfortable position of the head relative to the handle for a typical user will have the head bent approximately 20° toward the hand as shown in FIG. 4. Some users may prefer a flat arrangement as shown in FIG. 1 while others will prefer a more severe bend. A typical operating range which covers a majority of users would be from 0° to 45° as depicted by lines 40 and 42 in FIG. 4. Each time the neck is subjected to binding, the liklihood of fracture increases. In order to minimize the likelihood of fracturing the neck is most desirable to mold the toothbrush initially with the head oriented at a 20° angle relative to the handle to thereby minimize the maximum deformation required to reach either typical operating position. An angle slightly greater than 45° or a slight bend in the opposite direction may be desired from time to time with some users, but the occurence of such needs are infrequent.

It is also possible to form a toothbrush with an insert like the first embodiment which would also require heating of the neck to enable bending.

It will also be understood, of course, that while the form of the invention herein shown and described constitutes a preferred embodiment of the invention, it is not intended to illustrate all possible forms thereof. It will also be understood that the words used are words of description rather than limitation and various changes may be made without departing from the spirit and scope of the invention disclosed.

I claim:

1. A toothbrush comprising:

a brush head having at least one surface from which a plurality of bristles extend;

a handle to be held by a user;

a neck connecting the handle to said brush head formed of a thermoplastic material which softens to an inelastically deformable state when heated;

a deformable reinforcement insert extending through said neck and projecting at least partially into the handle and the brush head, said insert remaining rigid when the thermoplastic material is heated to the softened state;

wherein said neck may be inelastically deformed when temporarily heated allowing the angular orientation of said head relative to said handle to be varied allowing said user to choose any angle measured in the side elevation from 0° to 45° which is most comfortable, where 0° represents a straight head, neck, handle orientation, said insert maintaining the selected shape until the neck has cooled sufficiently to harden.

2. The invention of claim 1 wherein said thermoplastic material softens to an inelastically deformable state when heated above 150° F.

3. The invention of claim 1 wherein said neck is formed of a thermoplastic material softening to an inelastically deformable state when heated above 120° F.

4. The invention of claim 1, wherein said toothbrush is originally formed with the neck pre-bent to an angle measured in the side elevation substantially midway between 0° and 45°, thereby minimizing the maximum likely deformation required to obtain the shape desired by a typical user.

5. The invention of claim 1 wherein said reinforcment insert is formed of a ductile metal.

6. The invention of claim 5 wherein said ductile metal is soft steel.

* * * * *